US005518200A

United States Patent [19]

Kaji et al.

[11] Patent Number: 5,518,200

[45] Date of Patent: May 21, 1996

[54] METHOD OF PRODUCING CORELESS TOILET PAPER ROLLS AND THE CORELESS TOILET PAPER PRODUCED THEREBY

[75] Inventors: Kazushi Kaji, Iyomishima; Sukesada Watanabe, Fuji, both of Japan

[73] Assignees: Kaji Seisakusho Y.K., Ehime; Kasugaseishi Kogyo K.K., Shizuoka, both of Japan

[21] Appl. No.: 162,023

[22] PCT Filed: Apr. 15, 1992

[86] PCT No.: PCT/JP92/00480

§ 371 Date: Dec. 2, 1993

§ 102(e) Date: Dec. 2, 1993

[87] PCT Pub. No.: WO93/21094

PCT Pub. Date: Oct. 28, 1993

[51] Int. Cl.[6] ..... B65H 18/08; B65H 18/10

[52] U.S. Cl. ..... 242/538.1; 242/541.2; 242/544; 242/DIG. 3

[58] Field of Search ..... 242/538.1, 544, 242/160.1, 412, 412.3, 535.3, 542, 542.1, 541.2, DIG. 3

[56] References Cited

U.S. PATENT DOCUMENTS

| | | | |
|---|---|---|---|
| 4,783,015 | 11/1988 | Shimizu | 242/160.1 X |
| 4,958,111 | 9/1990 | Gago | 242/538.1 X |

FOREIGN PATENT DOCUMENTS

| | | | |
|---|---|---|---|
| 51-61049 | 5/1976 | Japan . | |
| 51-55404 | 5/1976 | Japan | B65H 75/18 |
| 54-152878 | 10/1979 | Japan | F16F 1/44 |
| 62-264154 | 11/1987 | Japan | B65H 23/198 |
| 63-036390 | 3/1988 | Japan | A47K 10/22 |
| 2-130292 | 10/1990 | Japan | A47K 10/16 |

*Primary Examiner*—John Q. Nguyen
*Attorney, Agent, or Firm*—R. Lawrence Sahr

[57] ABSTRACT

A coreless toilet paper roll is produced by winding toilet paper such that the winding speed in the winding apparatus is faster than the paper feeding speed in the paper feeding- and processing apparatus, during a beginning period and final period of the toilet paper winding step, by leaving the wound toilet paper roll in place, with the winding shaft leaves projecting radially outwardly for a pre-determined time after the winding step, and thereafter, by shrinking the leaves and removing the toilet paper roll from the winding shaft. The toilet paper roll so produced has a roll body made of a wound toilet paper material, wherein a beginning layer thereof is wound tightly, and subsequent turns of paper are gradually softened from a middle layer to an outermost layer, an aperture for receiving a supporting bar of a toilet paper holder formed through the center of the roll, and further, the inner surface of the aperture is smooth without projections.

1 Claim, 9 Drawing Sheets

METHOD OF PRODUCING CORELESS TOILET PAPER ROLLS AND THE CORELESS TOILET PAPER PRODUCED THEREBY

TECHNICAL FIELD

The present invention relates to a method of producing a coreless toilet paper roll and to the coreless toilet paper roll produced thereby. One of the most popularly used toilet paper holders, at present, is a type which has a pair of side brackets for mounting a detachable supporting bar. Generally, the detachable supporting bar is a metal or plastic hollow tube, in the form of a cylindrical section, having a diameter of about 20 to 35 mm. The most popularly used toilet paper roll is a type which comprises continuously wound or rolled toilet paper upon a paper tube or core onto which the toilet paper has been wound, as shown in FIG. 15. Referring to FIG. 15, the paper tube core C has an inner diameter of about 35 to 40 mm so as to permit it to be mounted to the above mentioned holder by way of the detachable supporting bar.

There has been known a type of coreless toilet paper roll which is made by winding toilet paper such that there is only a small center hole for receiving a thin rigid rod to be attached to a holder, for example, the rigid rod having a diameter of only about 5 to 10 mm or so. However, the present invention is not directed to such a type of coreless toilet paper roll. To the contrary, the coreless toilet paper roll to which the present invention is directed is the more popular type of toilet paper roll, referred to above, having a center hole capable of receiving therein the greater diameter detachable supporting bar as described above. The "core" of "the "coreless toilet paper roll" is merely a hollow aperture in the form of a cylindrical section extending axially through the "coreless toilet paper roll", in place of the above-mentioned paper tube core C (see FIG. 15) which is separate and distinct from the toilet paper itself. The "core" of the "coreless toilet paper roll" has a diameter of about 35 to 40 mm, and is formed by the internal diametrical surface of the "coreless toilet paper roll" of the present invention.

BACKGROUND OF THE INVENTION

In restrooms in public places, which are used by many different people, for example in hotel lobbies, hospitals, schools, and the like, depleted toilet paper rolls are relatively frequently exchanged for new toilet paper rolls, for example, every morning. This task requires the use of both hands, in complicated manipulation, to remove the paper tube cores C of the toilet paper rolls from the holders, to thereafter dispose of them, thus adding discrete elements of labor. Further, the requirement to use paper tube cores requires separate additional material cost, and requires discrete separate additional operations to set the paper tube onto the toilet paper roll winding shaft, prior to winding the toilet paper stock thereon, both of which increase production cost.

It is evident that labor, work steps and production costs can be reduced if paper tube cores are deleted from toilet paper rolls. Therefore, some proposals to produce coreless toilet paper rolls have been tried as follows:

(1) For example, Japanese unexamined patent publication No.5504/1976 and Japanese unexamined utility model publication No.130292/1991 both disclose methods characterized by the toilet paper being directly wound on a winding shaft without a paper tube core, with the winding shaft having a special construction for releasing the wound toilet paper roll. In particular, the winding shaft has movable leaves capable of opening/closing radially by manipulation of air pressure, such that the toilet paper can be wound on the winding shaft directly, while the leaves are expanded, and the wound toilet paper roll can be removed from the shaft by radially retracting the leaves after winding. In the process of winding the toilet paper on the winding shaft, after that shaft starts to rotate, the winding speed is increased to a given rate where it is then maintained. Then, the winding speed is decreased at the end of the winding period, and the rotation comes to a halt when the roll is completed. During this process, the toilet paper feed speed, produced by the paper feeding-and-processing apparatus, is controlled to produce a toilet paper feed rate which is substantially coordinated with the winding speed of the winding shaft, so as to avoid tearing the toilet paper stock, a material which has relatively low tensile strength. This method, however, has a drawback; because the winding tension of the toilet paper is maintained low, the outer or trailing end of the toilet paper on the roll tends to be loose, thus causing a tendency to unravel during subsequent handling. Further, during use of the winding shaft of that published reference, as shown in FIG. 13 hereof, the toilet paper tends to become caught between the mutually adjacent leaves 10 due to the pressure of the winding shaft, so that axially extending projections p are formed on the inner surface of the center hollow of the toilet paper roll T. In use, the projections p, tend to come into contact with the supporting bar of the toilet paper holder, thus producing an uncomfortable clattering noise as the toilet paper is unwound. In a public restroom, this can cause substantial embarrassment, especially if the user is a young woman. Further, when the paper is rapidly pulled from the roll, the paper may have more of a tendency to tear off, rather than to unwind.

(2) Another method of producing a coreless toilet paper roll is found in Japanese Unexamined Utility Model Publication No.61049/1976. Several layers of toilet paper, at the beginning of winding, are bonded together as a substitute for a paper tube core. However, since those bonded layers cannot be used, not all of the toilet paper on the roll can be used. Therefore, this method produces a product which is relatively uneconomical.

Among the foregoing problems, the inventors have paid special attention to the problems, related to producing tightly wound rolls of toilet paper, as basic problems to be solved. The inventors have energetically researched the reasons why toilet paper is not conventionally tightly wound, and have found the following:

At the beginning of winding a toilet paper roll, water or a water-solution of adhesive agent is sprayed onto the paper on the winding shaft in order to temporally fix the paper to the winding shaft or to temporally fix several paper layers together with each other. In this situation, the paper absorbs water and is elongated in both the longitudinal and lateral directions. The elongation in the longitudinal direction, in particular, is about 10% beyond the original length. Therefore, when the paper feed speed and the winding speed are mutually coordinated, because the end of the toilet paper being wound has elongated, the tension has been relaxed as the winding commences. Therefore, the inner-most portion of the toilet paper roll T tends to be loose after winding.

Further, near the end of the winding period, both the winding shaft and paper feeding-and-processing apparatus are gradually decelerated and come to halt as the winding is completed. During this deceleration, the toilet paper tends to move at a speed which is faster than the mechanical winder shaft, due to the inertia of the moving stream of the toilet paper. Therefore, again because of the reduced tension, the outside portion of the toilet paper roll tends to be loose.

Though the various reasons, as to why conventional toilet paper is not uniformly tightly wound into rolls, have been made clear through the research of the inventors, as mentioned above, it is still understood by those skilled in the art that consumable toilet paper rolls cannot be produced without winding the toilet paper around a paper tube C as a core, since the toilet paper has characteristics of low density, high flexibility due to crepe treatment or the like, and very low strength in comparison with, for example, newsprint or kraft paper for use in producing corrugated cardboard. This understanding, by those skilled in the art, is apparently based on what might be referred to as "technical common sense", in view of the foregoing characteristics of toilet paper. Thus, it seems that, for several decades since the first rolls of toilet paper appeared in the market place, no toilet paper, for use with detachable supporting bars as described above, has been commercially successfully produced and marketed without a paper tube used as a core.

The present invention overcomes the "technical common sense" with a method of producing a coreless toilet paper roll from which the paper will not become unintentionally loose. In other words, the present invention provides a coreless toilet paper roll which does not become loose, which has no inside projections, and from which virtually all of the toilet paper can be used.

DISCLOSURE OF INVENTION

According to the present invention, there is provided a method of producing a coreless toilet paper roll by providing a toilet paper winding means comprising a paper feeding-and-processing apparatus for unwinding toilet paper stock from a wound roll made by a paper making machine, processing that toilet paper stock, as occasion demands, and feeding the paper to a rewinding apparatus, and rewinding that toilet paper stock, by way of a rewinding apparatus comprising a winding shaft onto which that toilet paper stock is wound, to form a roll shape so as to produce a coreless toilet paper roll. The winding shaft comprises a tubular member with several rows of lugs, those lugs being capable of radially extending to project outwardly from the winding shaft axis and, in converse, retracting radially inwardly to draw back from that extended position toward the axis of the winding shaft. The winding shaft also comprises means to extend those lugs as well as means to retract those lugs. The winding shaft further comprises plural leaves, each having an arc-shaped cross section, extending in an axial direction and being fixed to the lugs of each row, and an elastic outer tube having a low coefficient of friction so as to produce good slideability, that elastic outer tube which covers the leaves. The toilet paper winding process comprises winding the toilet paper such that the winding speed in the rewinding apparatus is faster than the paper feeding speed in the paper feeding-and-processing apparatus, at both the beginning and final periods of the toilet paper winding step, and maintaining the fully wound toilet paper roll on the extended leaves as projected radially outwardly, for a period of time after the roll winding has been completed, and thereafter retracting the leaves radially inwardly followed by removing the toilet paper roll from the winding shaft.

In the present invention, even if the toilet paper elongates due to water spraying or the spraying of a water solution of adhesive agent at the beginning of the rewinding, the elongation caused thereby can be absorbed since, at the beginning of the rewinding process, the winding speed of the rewinding apparatus is faster than the paper feeding speed of the paper feeding-and-processing apparatus. Therefore, the toilet paper can be wound around the winding shaft with suitable tension from the very beginning. Further, though the toilet paper moves, due to dynamic inertia, with a speed faster than the decelerating mechanical apparatus, during the final period of rewinding, the over-run can be absorbed since the rewinding speed in the rewinding apparatus is faster than paper feed rate produced by the paper feeding-and-processing apparatus. Therefore, the toilet paper can also be wound with suitable tension during the final period of rewinding, as the toilet paper roll winding is completed. Further, since the leaves are left extended for a predetermined time after the rewinding step is completed, pressure is applied to the toilet paper, and thus, the configuration of the roll tends to become more fixed in place as the tension in the rolled paper gradually relaxes. Therefore, the configuration of the roll will not become loose for some extended period of time thereafter, thus enabling subsequent handling.

The winding shaft of the present invention has wide contacting surfaces, since the leaves radially divide the outer surface of the winding shaft into several sectors. Therefore, though the toilet paper is directly wound around the winding shaft without using a paper tube as a core, the inner surface of the wound toilet paper can be supported with low contact pressure between the toilet paper and the faces of the wide contacting surfaces of the leaves. Thus, though suitable tension is applied during the rewinding operation, and the finished roll is left under compressed conditions for a predetermined time thereafter, the toilet paper cannot be damaged. Further, since the leaves are wrapped or encompassed within an elastic outer tube, with a slidable outer surface, the paper is not pinched by the leaves, and therefore no projections are formed to extend radially inwardly from the center hollow of the roll.

Based on the above described method of production, according to the present invention, there is provided a toilet paper roll having a roll body made of wound toilet paper, wherein a beginning layer is wound tightly, and subsequent turns of paper are gradually softened, being progressively less tightly wound, to the outermost layer. The toilet paper roll includes an aperture, in the form of a cylindrical section, formed axially through the center of the roll, for receiving the supporting bar of a conventional toilet paper holder, the surface of that aperture being smooth and without projections.

BEST MODE FOR CARRYING OUT THE INVENTION

Figure 15:
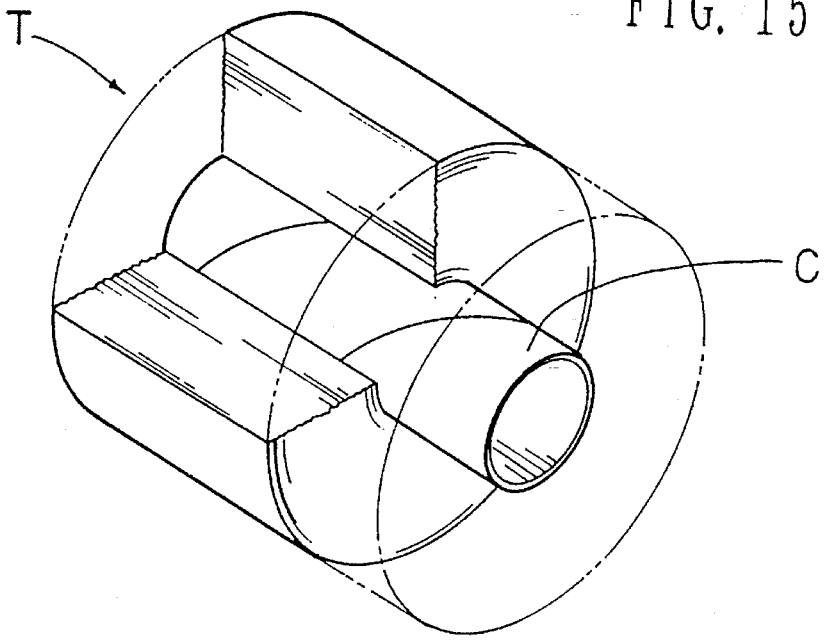
FIG. 15 is a semi-schematic perspective view showing a typical conventional toilet paper roll having a separate and distinct paper tube core.
Figure 13:
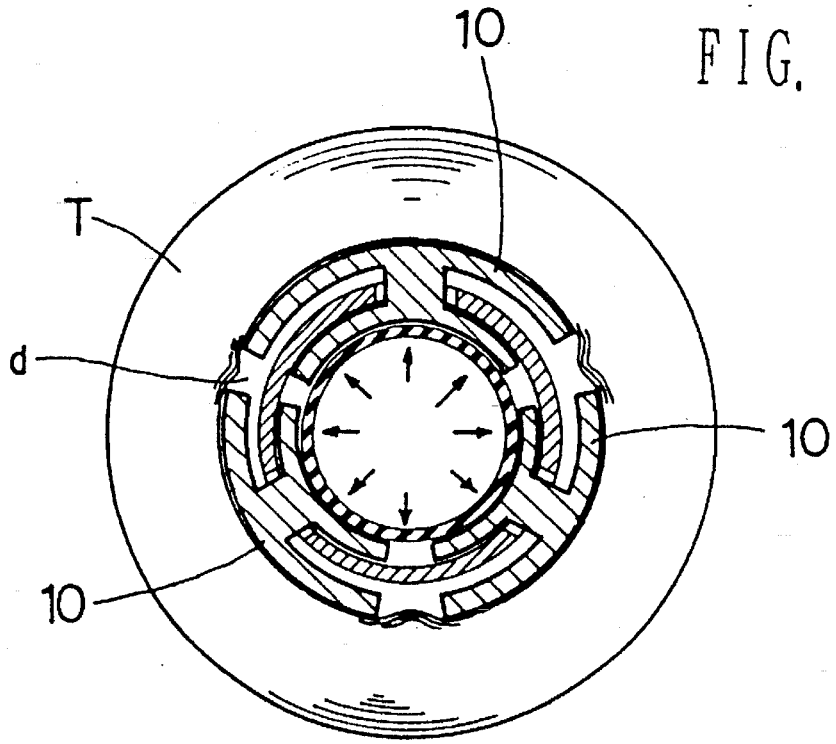
FIG. 13 is a sectional, semi-schematic view illustrating a winding operation using a known winding shaft.
Figure 14:
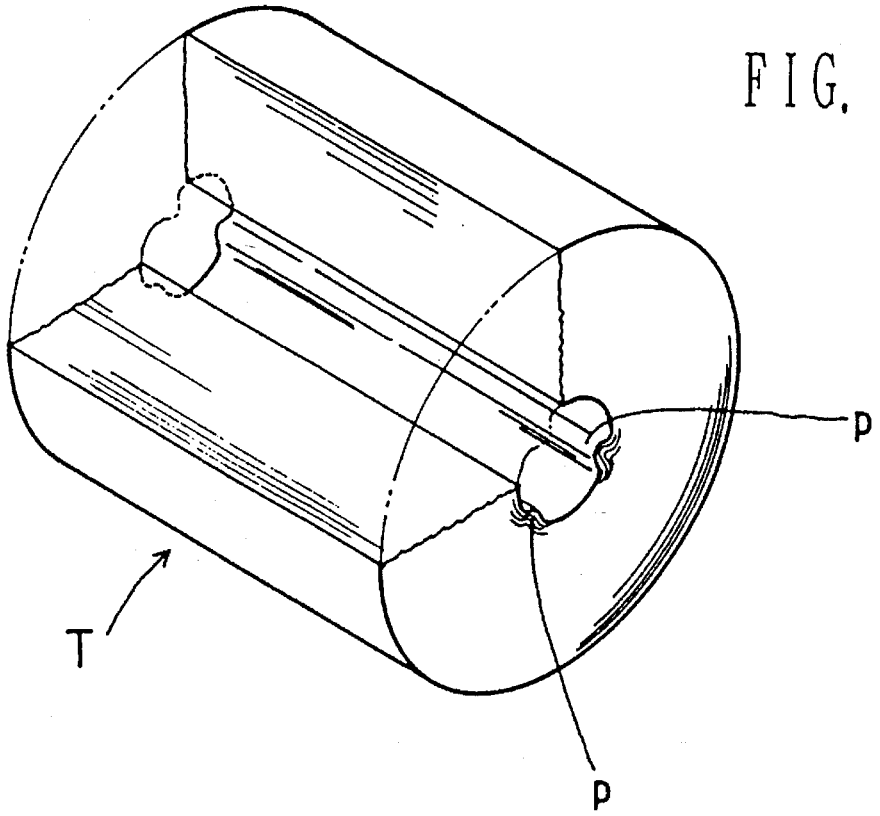
FIG. 14 is a view of a known toilet paper roll illustrating one of the problems which results from the use of the winding shaft shown in FIG. 13.

Hereinafter, embodiments of the present invention are explained with reference to the drawings. Referring to FIG. 13, there is shown a known toilet paper winder shaft which has been proposed for winding coreless toilet paper rolls, and an illustration of the problem created by the use thereof is shown in FIG. 14. FIG. 15 shows a conventional toilet paper roll having a paper tube core. Thus, FIGS. 13, 14 and 15 do not illustrate embodiments of the present invention.

Figure 12:
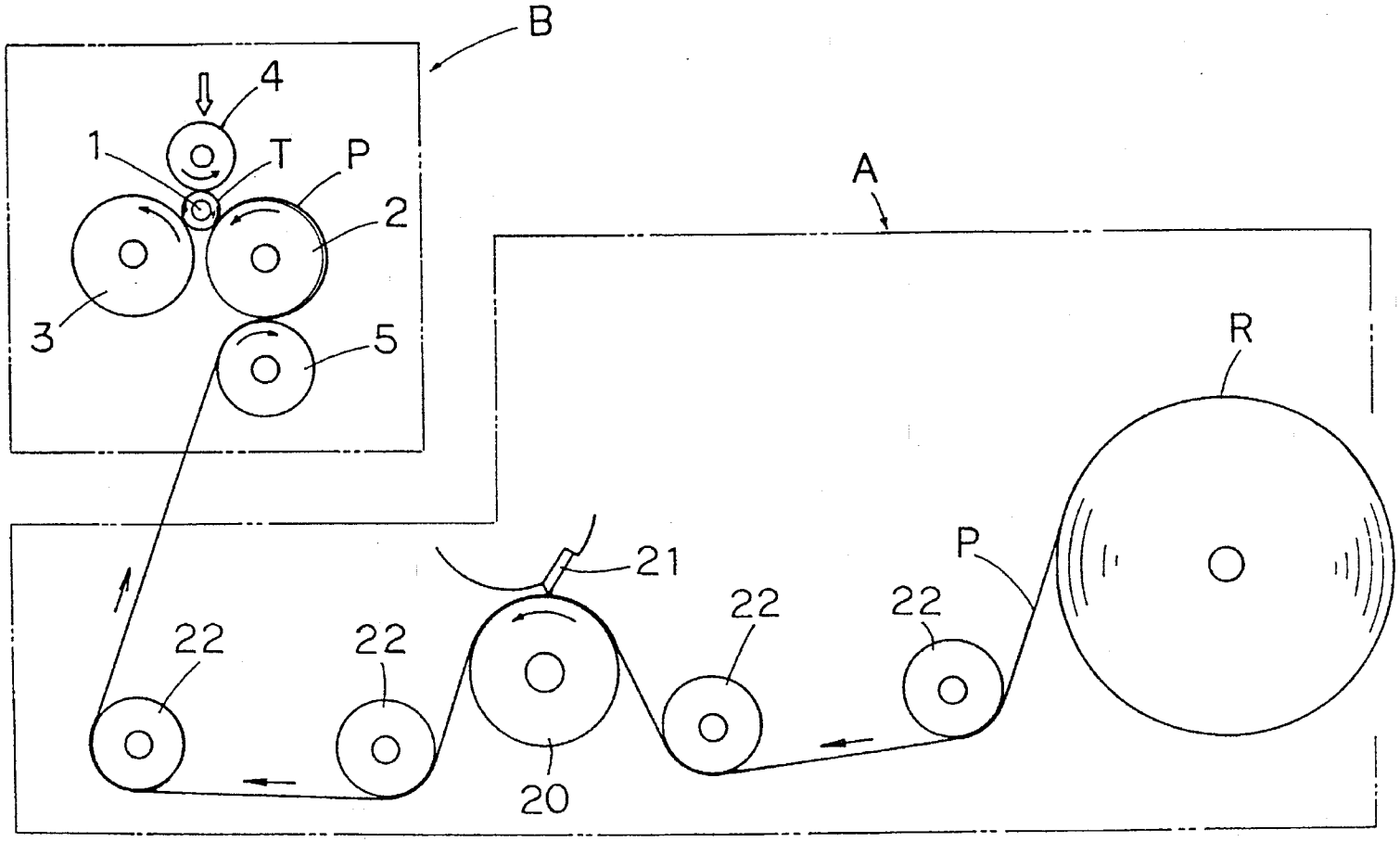
FIG. 12 is a schematic view illustrating a typical conventional toilet paper winder including both the paper feeding-and-processing apparatus A and the rewinding apparatus B.

As shown in FIG. 12, the mechanisms of the toilet paper winder can be generally divided into a paper feeding-and-processing apparatus A and a rewinding apparatus B. The paper feeding-and-processing apparatus A includes means for unwinding toilet paper stock P from a wound stock roll R, which is typically a roll of 1,000 to 1,500 mm in diameter, as produced by a paper making machine, as well as means for both processing the paper, as occasion demands, and for feeding the paper to the rewinding apparatus, indicated by numerals 20 through 22. The processing of paper, as occasion demands, as applied by the means for processing of the paper feeding-and-processing apparatus A, include the enablement of various kinds of processes, such as, for example, embossment processing, notching or perforation processing and crepe treatment processing. Such processing means are suitably included into in the paper feeding-and-processing apparatus A for application as occasion demands. In the embodiment shown in FIG. 12, a notching mechanism comprises a roller 20 and a cutter 21. Numeral 22 indicates guide rollers.

Rewinding apparatus B comprises means for rewinding toilet paper stock P on winding shaft 1 in order to produce a coreless toilet paper roll. In drawing FIG. 12, only the functional elements are shown. That is to say, rewinding apparatus B comprises driving rollers 2 and 3, riding roller 4 and nip roller 5. In rewinding apparatus B, as shown in FIG. 12, by rotating the driving rollers 2 and 3, toilet paper stock P, being fed to rewinding apparatus B by paper feeding-and-processing apparatus A, is wound onto winding shaft 1, and the developing toilet paper roll T is urged against winding shaft 1 by driving roller 3 and riding roller 4.

Figure 2:
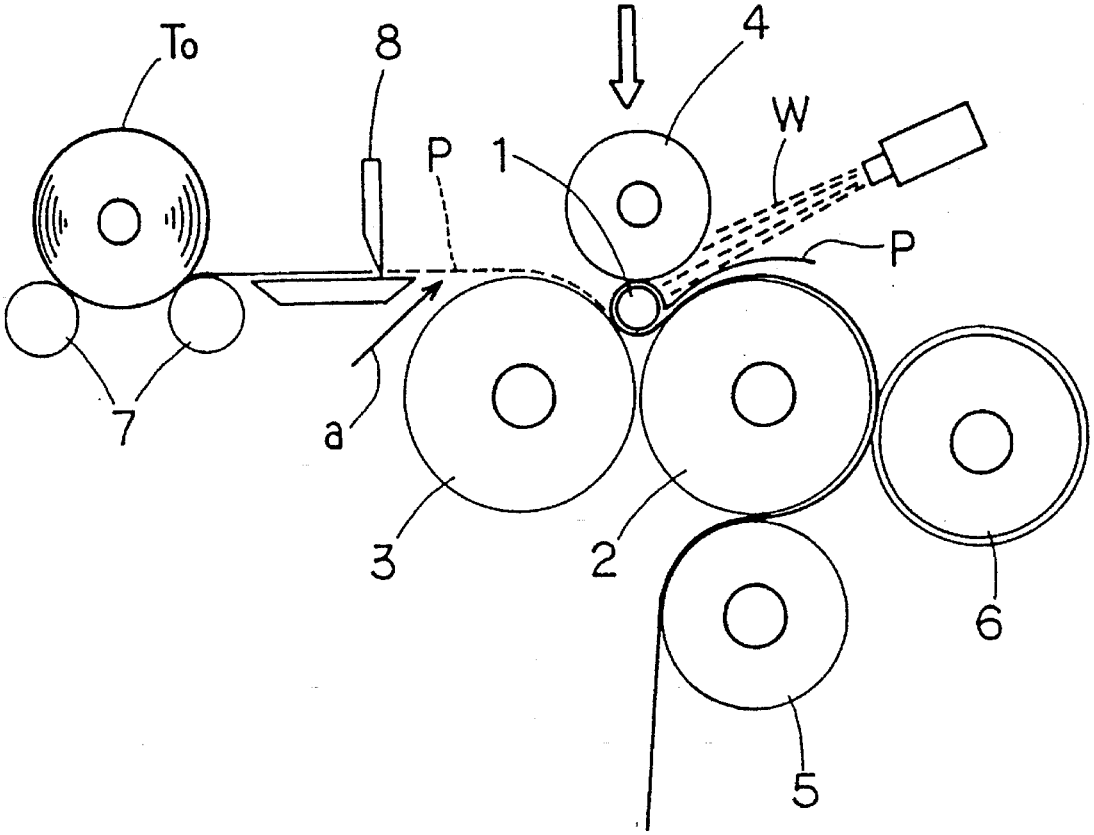
FIG. 2 is a schematic representation of a toilet paper roll winder.

FIG. 2 shows the beginning state of the winding of toilet paper stock P in rewinding apparatus B in somewhat more detail than is shown in FIG. 12. Wound roll R (see FIG. 12), after paper making, is typically 1,000 to 2,000 mm in width and is typically fed to rewinding apparatus B with the original width remaining. However, the wide paper is cut with rotary slitter 6, preferably into 113 mm widths as determined by JIS standard and to enable the toilet paper roll to be readily fitted into a standard toilet paper holder. Numeral 7 indicates a receiving stand for receiving toilet paper rolls after the winding thereof is completed, and numeral 8 indicates a knife for cutting the tail end of the fully wound toilet paper roll in the direction of its width. After the toilet paper roll TO, of which winding has been previously completed, is put on receiving stand 7, paper stock P is cut with knife 8, and the portion shown by a broken line of paper stock P is wound on winding roll 1 as shown by a solid line. Then, preferably water W, used for temporarily fixing paper stock P to winding roll 1, is sprayed onto the initial portion of paper stock P which is wound onto winding roll 1. (Water W is preferred as the cost of additional adhesive is eliminated and the use of all of the toilet paper on the roll is enabled.) Following this, riding roller 4 comes into contact with paper stock P, and driving rollers 2 and 3 begin to rotate. Since paper stock P is temporarily fixed to the winding shaft 1 and also to another layer of paper stock P, paper stock P is caused to wind, layer upon layer, as driving rollers 2 and 3 are rotated, and thus the diameter of the roll becomes gradually larger. The period during which preferably water is sprayed is referred to as the beginning period of winding. During the beginning period, either the whole of the beginning period or just part of it, the winding speed may be accelerated.

Figure 3:
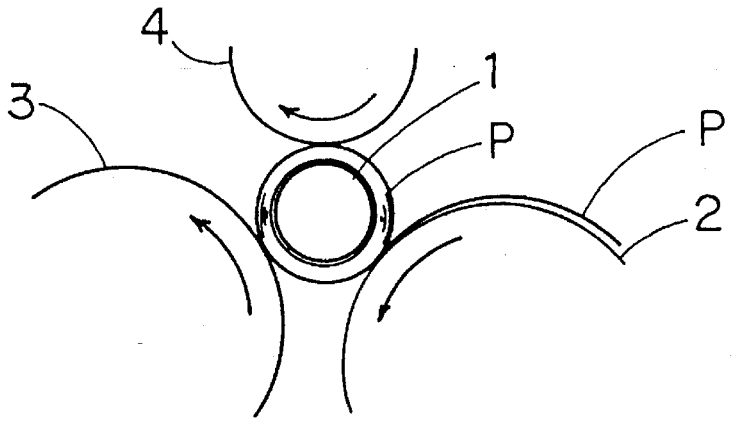
FIG. 3 and FIG. 4 are schematic representations illustrating steps in the winding of a toilet paper roll.
Figure 4:
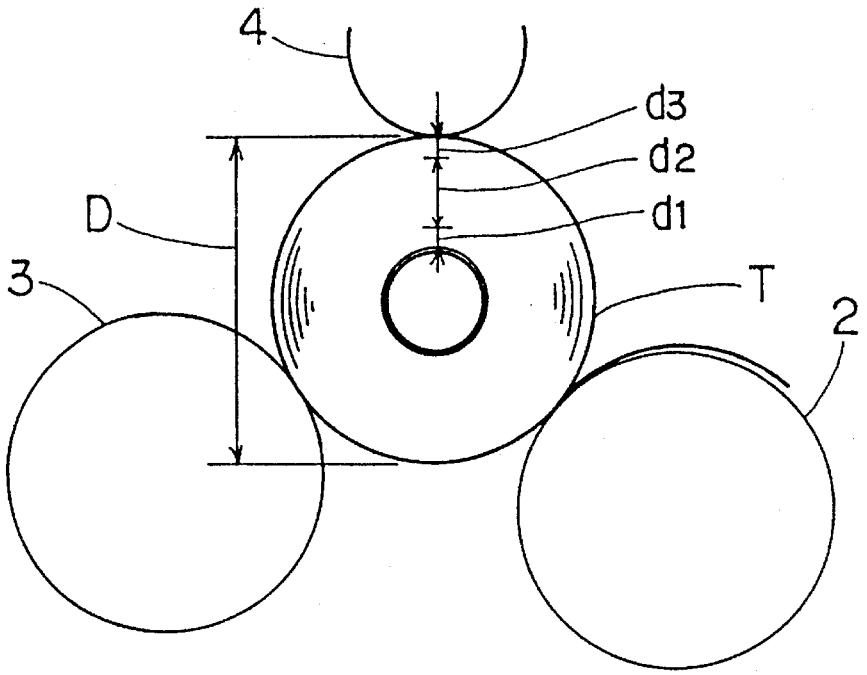
Figure 6:
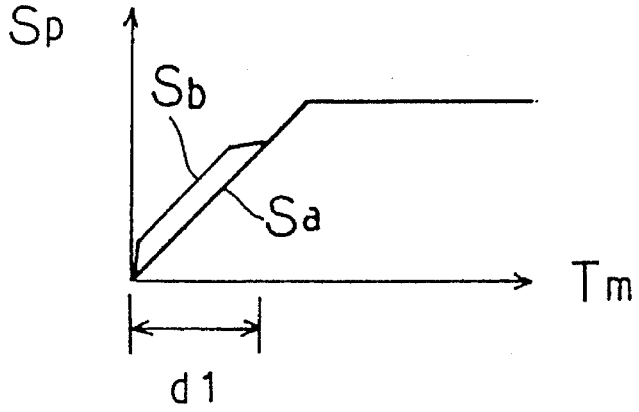
FIG. 6 and FIG. 7 are graphs showing relations between time and winding speed in alternate embodiments of the winding method of the present invention.

As shown in FIG. 3, when the diameter of the roll of toilet paper stock P is increased to a certain extent, the operation commences a middle period of winding where the rotational speed of the winding shaft 1 is preferably maintained constant, although acceleration and or deceleration may be employed during the middle period as illustrated in FIG. 6. As shown in FIG. 4, when the roll diameter D further increases and approaches the final desired diameter (which is preferably determined to be a maximum of 120 mm both to meet JIS standards and to enable the roll to be readily fitted into a standard toilet paper holder as described above), the operation shifts to a final period of winding where winding speed is decelerated, and winding is finally halted. In FIG. 4, marks d1, d2 and d3, respectively, show the beginning period, the middle period and the final period of winding, all of which together comprise a single winding cycle of the preferred embodiment of the present invention.

Figure 5:
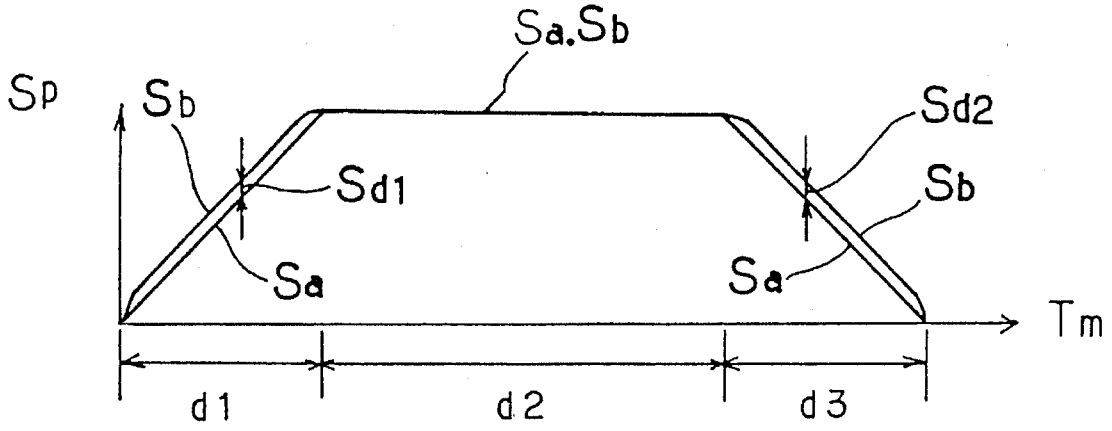
FIG. 5 is a graph showing the relation between time and winding speed in the preferred embodiment of the winding method of the present invention.

The changes of the feeding speed Sa and the paper winding speed Sb in one winding cycle, as mentioned above, are indicated in FIG. 5. In FIG. 5, Sp indicates winding speed velocity, and Tm indicates winding time. As shown in FIG. 5, the winding speed Sb in the rewinding apparatus B is faster than the paper feeding speed Sa from the paper feeding-and-processing apparatus A for the beginning period d1 and the final period d3, and the winding speed Sb and the paper feeding speed Sa are equivalent during the middle period d2.

According to the above described winding method and again referring to FIG. 5, during the beginning winding period d1, since the paper winding speed Sb is faster than the feeding speed Sa, elongation of the toilet paper stock P, caused by the sprayed water, can be absorbed, and further, paper stock P is thus wound with suitable tension. Therefore, paper stock P can be tightly wound during the beginning period d1. During the middle winding period d2, since the winding speed Sb is equivalent to the paper feed speed Sa, the tension of the winding gradually decreases. Therefore, the paper is wound more softly (less tightly). During the final winding period d3, though the winding speed Sb is faster than the paper feeding speed Sa, the tension continues to decrease and the paper continues to be wound softly, because the dynamic inertia of paper stock P operates in the direction in which paper stock P is being fed, during the final winding period, to over-ride the winding speed Sb during that final period. As a result, the toilet paper roll obtained has a tightly wound portion for the beginning period d1 and a gradually softened wound portion from the middle winding period layer through the outermost layer. However, by winding the toilet paper roll T as described, the paper stock P is still wound sufficiently tightly enough to substantially diminish the possibility of loosening during subsequent handling. Further, since the water sprayed during the beginning period will evaporate before the winding of the toilet paper roll T is completed, the paper stock P which was wound during the beginning period can be readily unwound, as intended, so that virtually all of the paper stock P of the toilet paper roll T can be used.

The above mentioned speed difference Sd1 and Sd2, between the winding speed Sb and the paper feeding speed Sa, can be calculated from, for example, the ratio of the elongation of the paper due to water spray, the ratio of deceleration due to dynamic inertia and the speed difference required for suitable tension. In general, the speed difference is about 10%; however, the difference can, of course, be lower or higher than 10%, depending, for example, on the construction and performance features of the particular rewinding apparatus B which is used and the quality of the paper.

Figure 7:
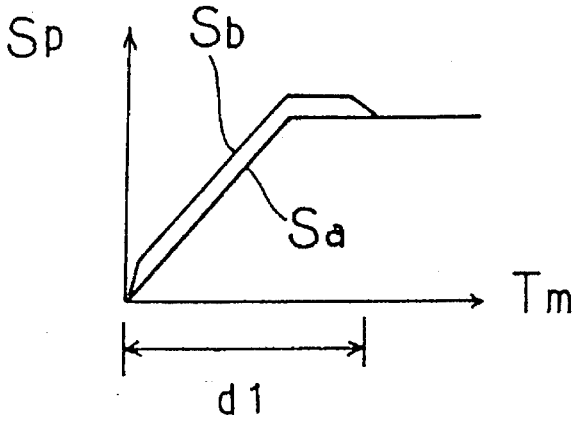

The beginning winding period d1, where the winding speed Sa is faster than the paper feeding speed Sb, corresponds to the acceleration range in the embodiment shown in FIG. 5. The beginning winding period d1 for the embodiment show in FIG. 6, however, terminates before the actual acceleration range is completed, thus that beginning winding period d1 of FIG. 6 comprises only a portion of the acceleration range. In the embodiment shown in FIG. 7, the beginning winding period d1 extends beyond the acceleration range, thus the acceleration is concluded and the constant speed range has commenced before the beginning winding period d1 has ended. In similar manner, the final winding period d3 can be only a portion of the deceleration range or the final winding period d3 can commence prior to the commencement of the deceleration range, with that final winding period d3 starting during the last portion of the constant speed range.

In the present invention, fine control of the paper stock P may be performed so as to finely adjust and thus optimize the paper winding tension. For example, when paper stock P is wound under tension, driving roll 2 rotates at a rate of about 0.2% above the paper feed speed as produced by the paper feeding-and-processing apparatus A, while driving roll 3 rotates at a rate of about 0.3% above the paper feed speed, and riding roll 4 rotates at a rate of about 0.4% above that paper feed speed. Accordingly, in the case where the paper feed speed Sa is 1.00 (as fed by the paper feeding-and-processing apparatus A), the resulting corresponding speed ratios become as set forth in the following table:

TABLE

| Element: | Beginning Period | Middle Period | Final Period |
|---|---|---|---|
| Driving Roller 2 | 1.12 | 1.02 | 1.12 |
| Driving Roller 3 | 1.13 | 1.03 | 1.13 |
| Riding Roller 4 | 1.14 | 1.04 | 1.14 |
| Paper Feeding-and-Processing Apparatus A | 1.00 | 1.00 | 1.00 |

Figures 8, 9:
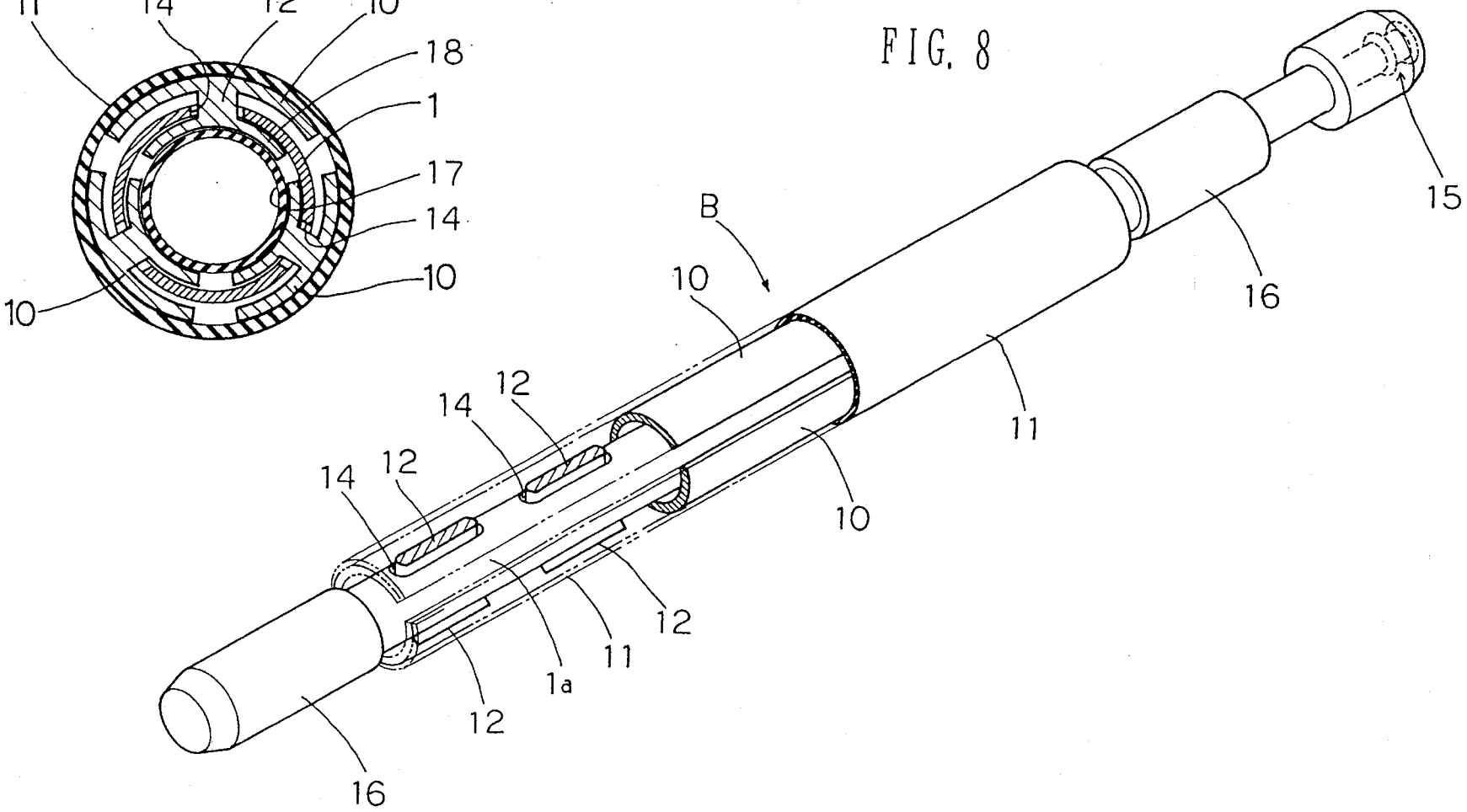
FIG. 8 is a cut-away, semi-schematic perspective view showing the preferred embodiment of a winding shaft according to the present invention.
FIG. 9 is a semi-schematic sectional view of the preferred embodiment of the winding shaft of the present invention.

Hereinafter, details of winding shaft 1 used in the rewinding apparatus B will be explained. FIG. 8 is a partially broken perspective view of the preferred embodiment of the winding shaft 1 of the present invention, and FIG. 9 is an enlarged sectional view of that winding shaft 1.

In FIGS. 8 and 9, 1*a* denotes a tubular member of the winding shaft. Tubular member 1*a* is a rigid metal tube. Tubular member 1*a* has, at both ends, bearing supports 16 for supporting the winding shaft 1 during winding operations. An elastomeric tube 17, preferably made of rubber or polyurethane, is inserted into tubular member 1*a*, and air can be fed in and exhausted from the elastomeric tube 17 through an air vent 15 provided at a first end of the winding shaft 1. The elastomeric tube 17 is closed at the other, second end to which the air vent 15 is not connected, and therefore, the elastomeric tube 17 is inflated radially as air is supplied, and is correspondingly deflated as air is exhausted.

Tubular member 1*a* has elongated apertures 14 circumferentially spaced apart preferably at 120°, with several sets of circumferentially spaced-apart apertures 14 being axially spaced apart along the length of tubular member 1*a* as best indicated in FIG. 8. A lug 12 is inserted in each elongated aperture 14 such that each such lug 12 can slideably extend and retract in a radial direction through its corresponding elongated aperture 14. A leg member 18 having an arc-shaped cross section and extending in the axial direction of winding shaft 1 is fixed to the lower end of each lug 12, and each leg member 18 is situated between the inside surface of the tubular member 1*a* and the outside surface of the elastomeric tube 17 as shown in FIG. 8. As used herein, the term "row" means a group of elongated apertures 14 or lugs 12 aligned in the axial direction in respect to tubular member 1*a*. The embodiment shown in FIGS. 8 and 9 has three rows, and is preferably sized such that each row has ten elongated apertures 14 and ten corresponding lugs 12.

Further, each lug 12 has a leaf 10 fixed thereto. The leaf 10 is preferably made of Duralumin® aluminum alloy, although other materials could be used. The leaf 10 might be formed with one or more lugs 12 as a single body, or a separable leaf might be fixed to each lug 12, for example, by fastening with bolts or screws. The leaf 10 has an arc-shaped cross section and extends in the axial direction. Thus, by fixing the leaves 12 on all of rows of the lugs 12, the outside surface of the tubular member 1*a* is substantially covered with leaves 10, with the exception of small gaps between adjacent leaves 10. The circumferential outline formed by the leaves 10 is substantially a complete circle broken only by the small gaps between adjacent leaves 10.

Preferably there is a single leaf 10 fixed to all of the lugs 12 which are aligned in a single row. Also preferably the lugs 12 and leaves 10 are arranged as three rows in the preferred embodiment, however two rows, or four or more rows may be employed. Further, the number of elongated apertures 14 in a row might be greater or less than ten. Further, a single leaf 10 may be fixed to each lug 12, or the leaves 10 can be divided into two or more pieces in the axial direction, especially if the winding shaft 1 is long, thus two or more axially aligned leaves 10, fixed to correspondingly positioned lugs 12 in each row, can be utilized.

The leaves 10 are all covered with an outer tube 11 so as to wrap or encase the leaves 10. The outer tube 11 is suitably elastomeric, i.e., it can be radially expanded and collapsed within its limits of elasticity, and the surface thereof should preferably have a low coefficient of friction in respect to paper stock P. In other words, the outer surface of outer tube 11 preferably has good slideability to enhance and enable toilet paper roll T being remove therefrom. For example, a polyurethane resin tube may be suitably employed.

Figure 10:
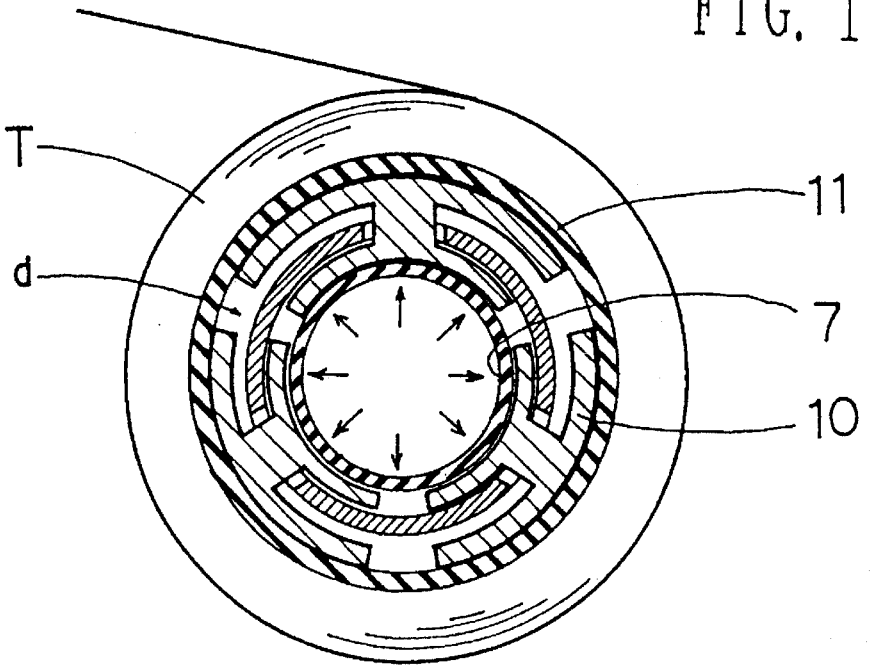
FIG. 10 is a semi-schematic sectional view showing the preferred embodiment of the winding shaft of the present invention with the leaves extended.
Figure 11:
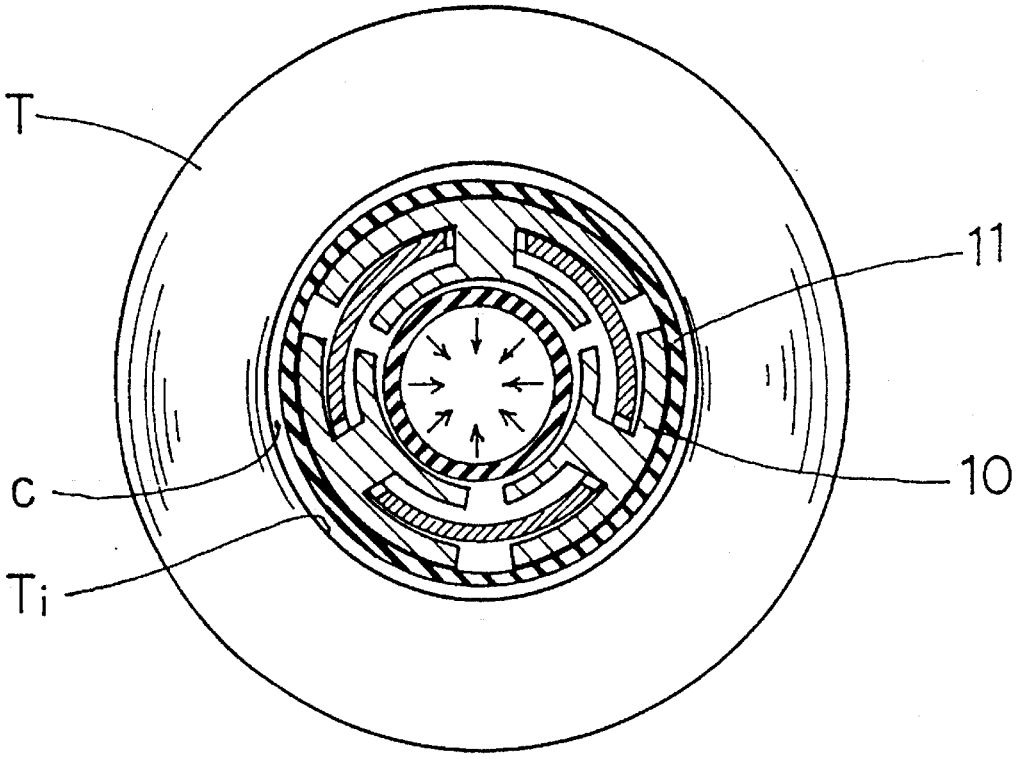
FIG. 11 is a semi-schematic sectional view showing the preferred embodiment of the winding shaft of the present invention with the leaves retracted.

In the above described embodiment, the leaves 10 are expanded radially as shown in FIG. 10, when air is supplied into the elastomeric tube 17 through the air vent 15, and the leaves 10 are closed radially as shown in FIG. 11, when air is exhausted from elastomeric tube 17 through air vent 15. It should be noted that other gases, e.g., nitrogen, can be used instead of air.

When a toilet paper roll T is wound on the winding shaft 1 of the preferred embodiment, with the above described construction as shown in FIGS. 8 through 11, the toilet paper roll T is wound while winding shaft 1 is in such a state that the three leaves 10 are expanded radially as shown in FIG. 10. In this case, an outer tube 11 exists on the outer surface of the three leaves 10, those three leaves 10 which have an almost correct circular profile in the expanded position. Since the inner surface of the toilet paper role T is substantially wholly in contact with the outer surface of the outer tube 11, the toilet paper roll T can be wound without a paper tube core. When the winding shaft 1 is used, no axial projection are formed on the inner surface of the hollow h of the toilet paper roll T, since the paper stock P is not pushed and cramped into the gaps d, due to the gaps d being covered and thus blocked by outer tube 11. The gaps d between adjacent leaves 10 are closed, with the adjacent leaves 10 coming closer together, as the leaves 10 are retracted.

After the winding operation has concluded, the leaves 10 are maintained in the radially extended position, as shown in FIG. 10, for a pre-determined period, for example, as much as 10 to 20 minutes or more. During that period, referred to as the "roll shape development period", the toilet paper roll T is subjected to pressure, and therefore, it becomes fixed in shape and size, i.e., due to a gradual relaxation of the stress imparted to the paper stock P during winding, the toilet paper roll T becomes capable of maintaining its shape without adhesive, external pressure or packaging for an extended period of time, thus enabling easy subsequent handling.

After the roll shape development period, air is exhausted through air vent 15 to retract or close the leaves 10 to the position shown in FIG. 11. Then, since some gap C, as shown in FIG. 11, is produced between the inner surface of the wound toilet paper roll T and the outer tube 11, the toilet paper roll T can be readily slipped off of an end of winding shaft 1 over bearing support 16. Since the outer tube 11 has good slideability, such slipping-off is easily accomplished, and thus snagging of the inner surface of toilet paper roll T is avoided, such snagging which might cause paper stock P to loosen unintentionally.

Figure 1:
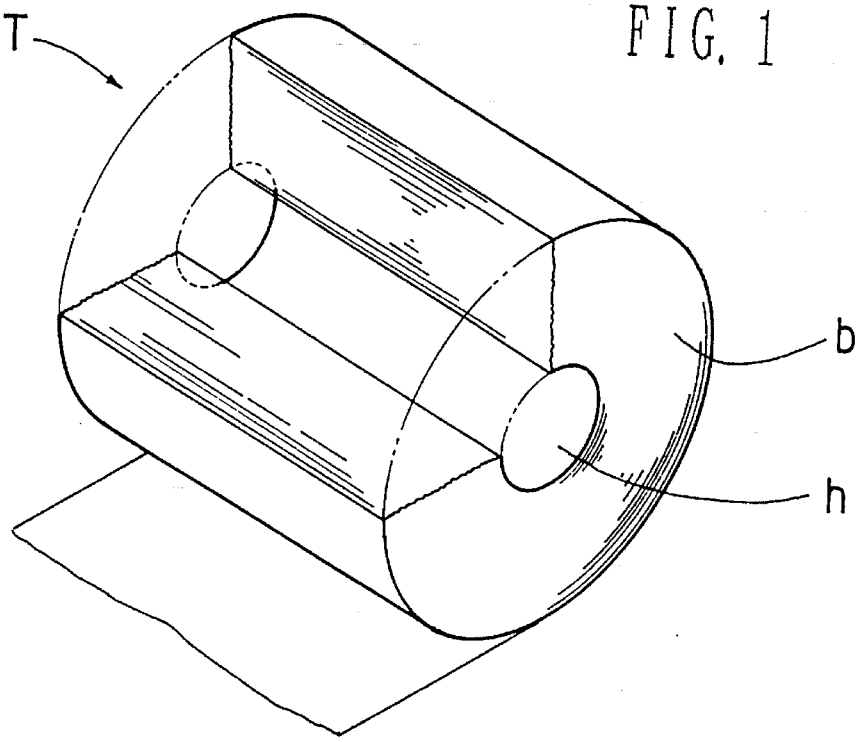
FIG. 1 is a perspective view showing a coreless toilet paper roll which is a preferred embodiment of the present invention.

FIG. 1 shows a coreless toilet paper roll T according to the present invention, which is obtained through practice of the above described method. As shown in FIG. 1, no paper tube core is used in the coreless toilet paper roll T, and the roll body is made by merely winding raw paper b for toilet paper use. An aperture h, sized to enable the easy insertion of the supporting bar of a conventional toilet paper holder, is formed to axially extend through the center of the roll body.

The toilet paper T can be rendered usable by setting the dimensions to correspond to the most popular toilet paper holders, thus enabling the insertion of a detachable supporting bar through the center aperture h and the fitting of the roll to the holder. When all the toilet paper is spent, the toilet paper holder can be refilled by merely mounting a new toilet paper roll T onto the supporting bar, without the need of complicated hand manipulation to remove that support bar with a paper tube core over it, since there is no paper tube core left on the supporting bar. Therefore, there is no problem in removing, collecting and disposing of paper tube cores as is required in the use of conventional toilet paper rolls as shown in FIG. 15. Further, for the toilet paper roll of the present invention, all of the toilet paper can be used to the last, since the paper is merely wound with water, and preferably without the use of any additional adhesive agent dissolved in that water. Finally, when the toilet paper roll of the present invention is used, rotation of the roll does not create any uncomfortable noise which might create embarrassment, as there is nothing projecting from the inner surface of that toilet paper roll which can cause clatter or noise as the toilet paper roll is rotated to dispense the toilet paper.

Any known material for the toilet paper can be used for the material of the toilet paper roll of the present invention. For example, various paper materials made from crushed wood pulp, bleached chemical pulp, old paper pulp, and the like can be employed, and further, crepe processed paper or embossed paper also can be employed.

Industrial Applicability

According to the present invention, a coreless toilet paper roll without any inside axially extending projections can be produced, and the toilet paper roll is capable of holding its own form for an extended period after it has been wound.

Further, the coreless toilet paper roll does not require any complicated hand manipulation to remove the supporting bar from the toilet paper holder, due to a paper tube core, nor any work related to the collection and disposal of such paper tube cores as may be the case in hotels or the like, and the toilet paper on the roll can be used to the last without creating embarrassment. Further, the cost of separate paper tube cores is eliminated.

What is claimed is:

1. A method of producing a coreless toilet paper roll comprising:

a) feeding toilet paper stock from a toilet paper stock roll to means for feeding and processing said toilet paper stock;

b) feeding said toilet paper stock from said means for feeding and processing to means for rewinding said toilet paper stock, said means for rewinding which comprises winding shaft means for winding toilet paper stock and imparting pressure thereto;

c) temporarily fixing a lead end of said toilet paper stock directly to said winding shaft means; then d) engaging said winding shaft means to commence winding said toilet paper stock onto said winding shaft means by rotation of said winding shaft means such that the speed of winding of said toilet paper is greater than the speed of feeding said toilet paper stock to said means for rewinding during a beginning winding period; then e) conforming said speed of winding of said feeding of said toilet paper stock to said rewinding means during a middle winding period; then f) controlling said winding shaft means such that the speed of winding of said toilet paper is greater than the speed of feeding said toilet paper stock to said means for rewinding during a final winding period to complete the winding of said coreless toilet paper roll; then g) maintaining said completely wound coreless toilet paper roll on said winding shaft means, under pressure imparted by said winding shaft means, for a predetermined period of time; then h) relaxing said pressure imparted by said winding shaft means; and then i) removing said coreless toilet paper roll from said winding shaft means.

* * * * *